US006111413A

United States Patent [19]

Hoehn

[11] Patent Number: 6,111,413

[45] Date of Patent: Aug. 29, 2000

[54] DIGITAL DEGREE WHEEL FOR TESTING IGNITION TIMING

[76] Inventor: Roland R. Hoehn, 4301 N. Springfield, Chicago, Ill. 60618

[21] Appl. No.: 09/067,478

[22] Filed: Apr. 27, 1998

[51] Int. Cl.[7] ..... F02P 17/00; F02P 5/00; F02M 5/100

[52] U.S. Cl. ..... 324/391; 324/392; 123/406.26; 123/406.6; 123/487

[58] Field of Search ..... 324/391, 392, 324/384, 385, 386; 123/406.26, 406.11, 406.6, 487

[56] References Cited

U.S. PATENT DOCUMENTS

| | | | |
|---|---|---|---|
| 3,961,239 | 6/1976 | Lach | 324/15 |
| 4,079,311 | 3/1978 | Roth | 324/16 |
| 4,251,774 | 2/1981 | Knodler | 324/384 |
| 4,304,203 | 12/1981 | Garcea et al. | 123/416 |
| 4,331,029 | 5/1982 | Wilson | 324/391 |
| 4,472,779 | 9/1984 | Marino et al. | 364/431.01 |
| 5,010,864 | 4/1991 | Matsuoka et al. | 123/414 |
| 5,146,168 | 9/1992 | Shaland | 324/392 |
| 5,431,134 | 7/1995 | Budde et al. | 324/391 |

*Primary Examiner*—Safet Metjahic
*Assistant Examiner*—James Kerveros

[57] ABSTRACT

A digital degree wheel is provided including an engine sensor mounted to at least one of a camshaft, distributor and crankshaft of a vehicle for generating an activation signal after the detection of the rotation thereof. An ignition sensor connected to an ignition of the vehicle for generating a deactivation signal upon the detection of the advancing of the ignition of the vehicle. A display connected to the ignition sensor and the engine sensor for displaying a plurality of numeric digits representative of a timer, which is adapted to begin upon the receipt of the activation signal and further cease upon the receipt of the deactivation signal for setting and checking the ignition and valve timing of an engine of the vehicle.

1 Claim, 4 Drawing Sheets

DIGITAL DEGREE WHEEL FOR TESTING IGNITION TIMING

BACKGROUND OF THE INVENTION

1. Field of the Invention

The present invention relates to a digital degree wheel and more particularly pertains to setting or checking both the ignition and valve timing of internal combustion engines.

2. Description of the Prior Art

The use of valve timing tools is known in the prior art. More specifically, valve timing tools heretofore devised and utilized for the purpose of checking timing on engines are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. Nos. 3,961,239; 4,304,203; 4,079,311; 5,146,168; 5,010,864; and 4,472,779.

In this respect, the digital degree wheel according to the present invention substantially departs from the conventional concepts and designs of the prior art, and in so doing provides an apparatus primarily developed for the purpose of setting or checking both the ignition and valve timing of internal combustion engines.

Therefore, it can be appreciated that there exists a continuing need for a new and improved digital degree wheel which can be used for setting or checking both the ignition and valve timing of internal combustion engines. In this regard, the present invention substantially fulfills this need.

SUMMARY OF THE INVENTION

In view of the foregoing disadvantages inherent in the known types of valve timing tools now present in the prior art, the present invention provides an improved digital degree wheel. As such, the general purpose of the present invention, which will be described subsequently in greater detail, is to provide a new and improved digital degree wheel which has all the advantages of the prior art and none of the disadvantages.

To attain this, the present invention essentially comprises a push button switch for generating a manual signal upon the depression thereof. Further provided is an engine sensor mounted to either the camshaft, distributor or crankshaft of a vehicle. The engine is adapted for generating an activation signal upon the rotation of the engine component to which it is connected. Associated therewith is an ignition sensor connected to an ignition of the vehicle for generating a deactivation signal upon the detection of the advancing of the ignition of the vehicle. A display means is connected to the ignition sensor and the engine sensor for displaying a plurality of numeric digits representative of a timer. Such timer is adapted to begin upon the receipt of the activation signal and further cease upon the receipt of the deactivation signal. As such, a user may is permitted to set and check the ignition and valve timing of an engine of the vehicle. A plurality of switch means is provided for controlling the operation of the timer of the display means. A first switch means has a first orientation for governing the display means such that the timer runs at a first rate and a second orientation for governing the display means such that the timer runs at a second rate. A second switch means is provided having a first orientation for governing the display means such that the timer decrements. The second switch means further includes a second orientation for governing the display means such that the timer increments. A third switch means is included having a first orientation for allowing the latching of the timer of the display means and precluding the restarting of the timer of the display means until the receipt of the manual signal. In a second orientation, the third switch means functions for allowing the latching of the timer of the display means and further allowing the restarting of the timer of the display means by the activation signal.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved digital degree wheel which has all the advantages of the prior art valve timing tools and none of the disadvantages.

It is another object of the present invention to provide a new and improved digital degree wheel which may be easily and efficiently manufactured and marketed.

It is a further object of the present invention to provide a new and improved digital degree wheel which is of a durable and reliable construction.

An even further object of the present invention is to provide a new and improved digital degree wheel which is susceptible of a low cost of manufacture with regard to both materials and labor, and which accordingly is then susceptible of low prices of sale to the consuming public, thereby making such digital degree wheel economically available to the buying public.

Still yet another object of the present invention is to provide a new and improved digital degree wheel which provides in the apparatuses and methods of the prior art some of the advantages thereof, while simultaneously overcoming some of the disadvantages normally associated therewith.

Still another object of the present invention is to set or check both the ignition and valve timing of internal combustion engines.

Lastly, it is an object of the present invention to provide a new and improved digital degree wheel including an engine sensor mounted to at least one of the camshaft, distributor and crankshaft of a vehicle for generating an activation signal after the detection of the rotation thereof;

an ignition sensor connected to an ignition of the vehicle for generating a deactivation signal upon the detection of the advancing of the ignition of the vehicle; and display means connected to the ignition sensor and the engine sensor for displaying a plurality of numeric digits representative of a timer which is adapted to begin upon the receipt of the activation signal and further cease upon the receipt of the deactivation signal for setting and checking the ignition and valve timing of an engine of the vehicle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
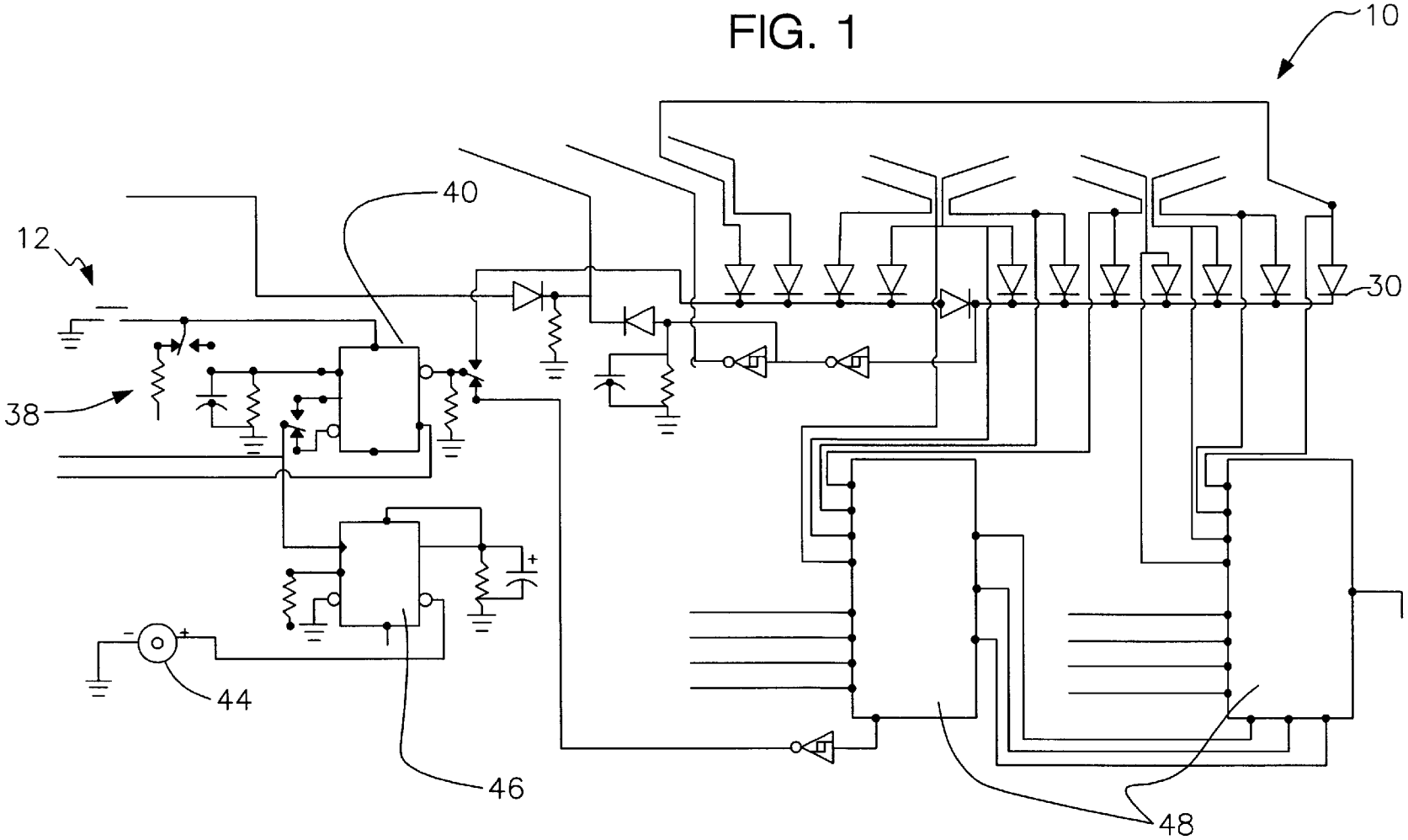
FIG. 1 is a schematic diagram depicting the display means, third switch means, and the manual push button switch.

With reference now to the drawings, and in particular to FIG. 1 thereof, a new and improved digital degree wheel embodying the principles and concepts of the present invention and generally designated by the reference numeral 10 will be described.

The present invention, the new and improved digital degree wheel,is comprised of a plurality of components. Such components in their broadest context include an engine sensor, ignition sensor and a plurality of switch means. Such components are individually configured and correlated with respect to each other so as to attain the desired objective.

Figure 4:
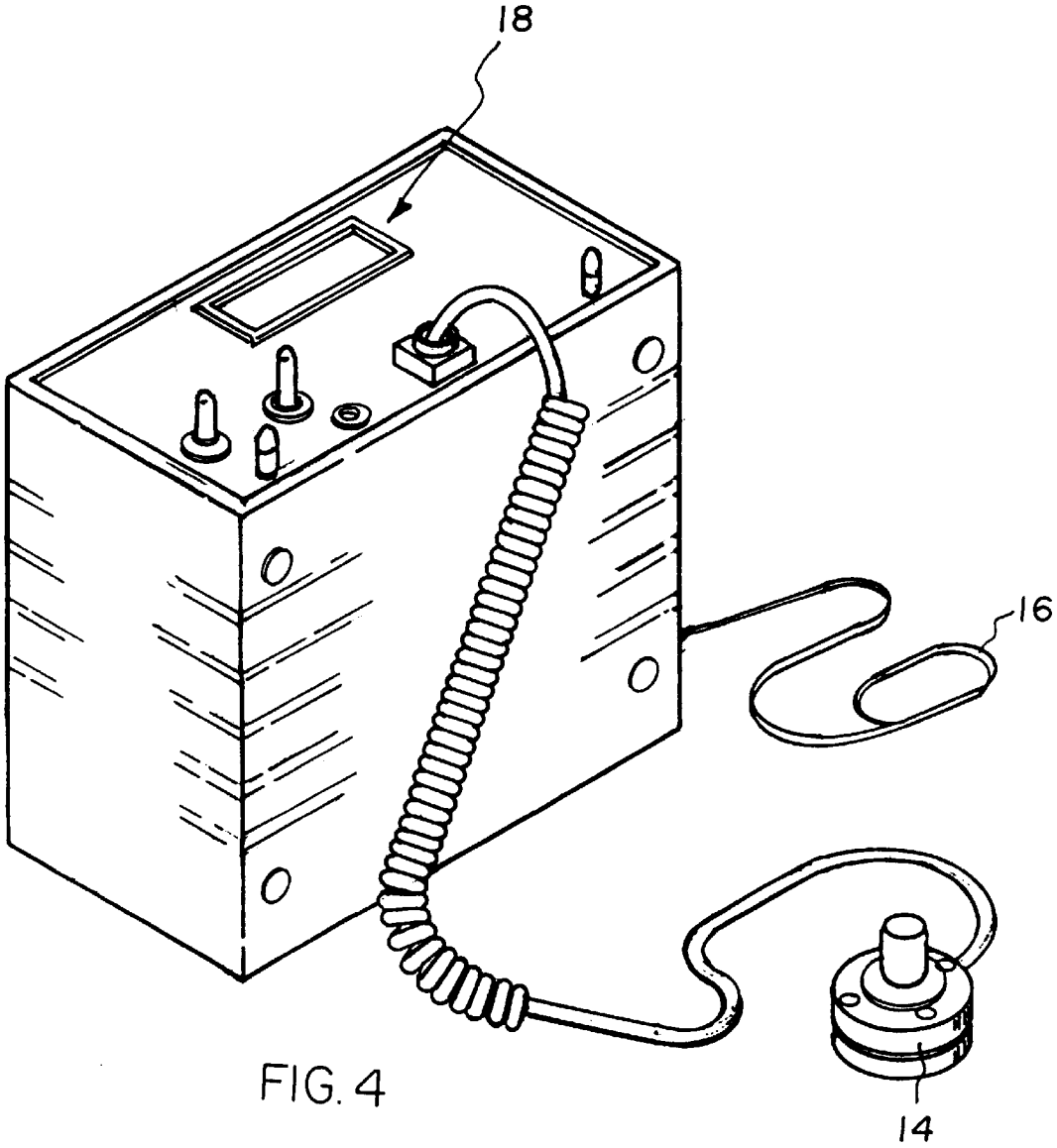
FIG. 4 is a perspective view of the housing in which the circuitry of the present invention is situated.

More specifically, it will be noted that the system 10 of the present invention includes a push button switch 12 adapted to generate a manual signal upon the depression thereof for reasons that will become apparent later. Note FIGS. 1 & 4.

Further provided is an engine sensor 14 mounted to either the camshaft, distributor or crankshaft of a vehicle. The engine is adapted for generating an activation signal upon the rotation of the engine component to which it is connected. It should be understood that the activation signal preferably takes the form of a low to high transmission. The engine sensor may take the form of a photosensor threadedly mounted within a spark plug hole of the engine of the vehicle. Such sensor is adapted to provide an indication upon the downward movement of an associated piston after being abutted therewith.

Next provided is an ignition sensor 16 connected to an ignition of the vehicle for generating a deactivation signal. It is important that the deactivation signal be generated only upon the detection of the advancing of the ignition.

A digital display means 18 is connected to the ignition sensor and the engine sensor for displaying a plurality of numeric digits representative of a timer, or counter. Such timer is adapted to begin upon the receipt of the activation signal and further cease upon the receipt of the deactivation signal. As such, a user is permitted to set and check the ignition and valve timing of the vehicle. The digital display means have a plurality of 360 counters 20 associated therewith for affording the timing operation thereof.

Figure 3:
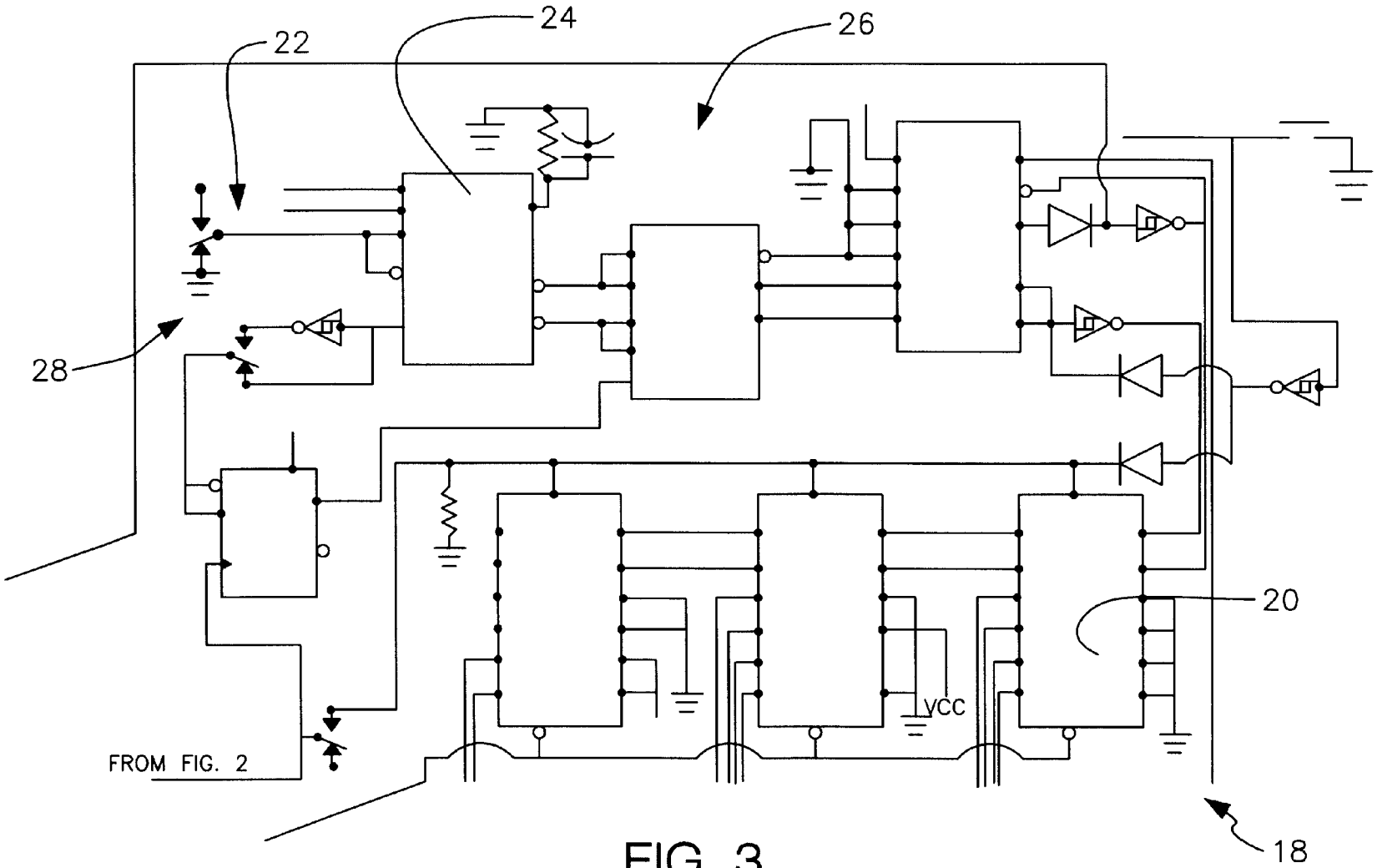
FIG. 3 is a schematic diagram including the first switch means and second switch means.

A plurality of switch means is provided for controlling the operation of the timer of the display means. As shown in FIG. 3, a first switch means 22 is provided. The first switch has a first orientation for governing the display means such that the timer runs at a first rate and a second orientation for governing the display means such that it runs at a second rate.

Specifically, the first switch means ensures that the timer runs in X4 mode in the first orientation for correct counting when the engine sensor is connected to the camshaft or distributor of the vehicle. In such orientation, the first switch means delivers a 0.5 degree resolution per full rotation. Further, the timer is run in X2 mode when in the second orientation. This orientation is specifically tailored for when the engine sensor is connected to the crankshaft of the engine. A 0.5 degree resolution per one 180 degree resolution is delivered by the first switch means when in the second orientation. To accomplish its intended function, associated with the first switch means is a clock converter 24 and up and down counter 26, as shown in FIG. 1.

A second switch means 28 is provided having a first orientation for governing the display means such that the timer decrements. When in this orientation, the second switch means is adapted for checking ignition, valve etc timing before being positioned at top dead center. In the present mode, the diode bus 30 shown in FIG. 1 serves to reload the 360.0 counters to 360 when such counters reach 000.0.

Figure 2:
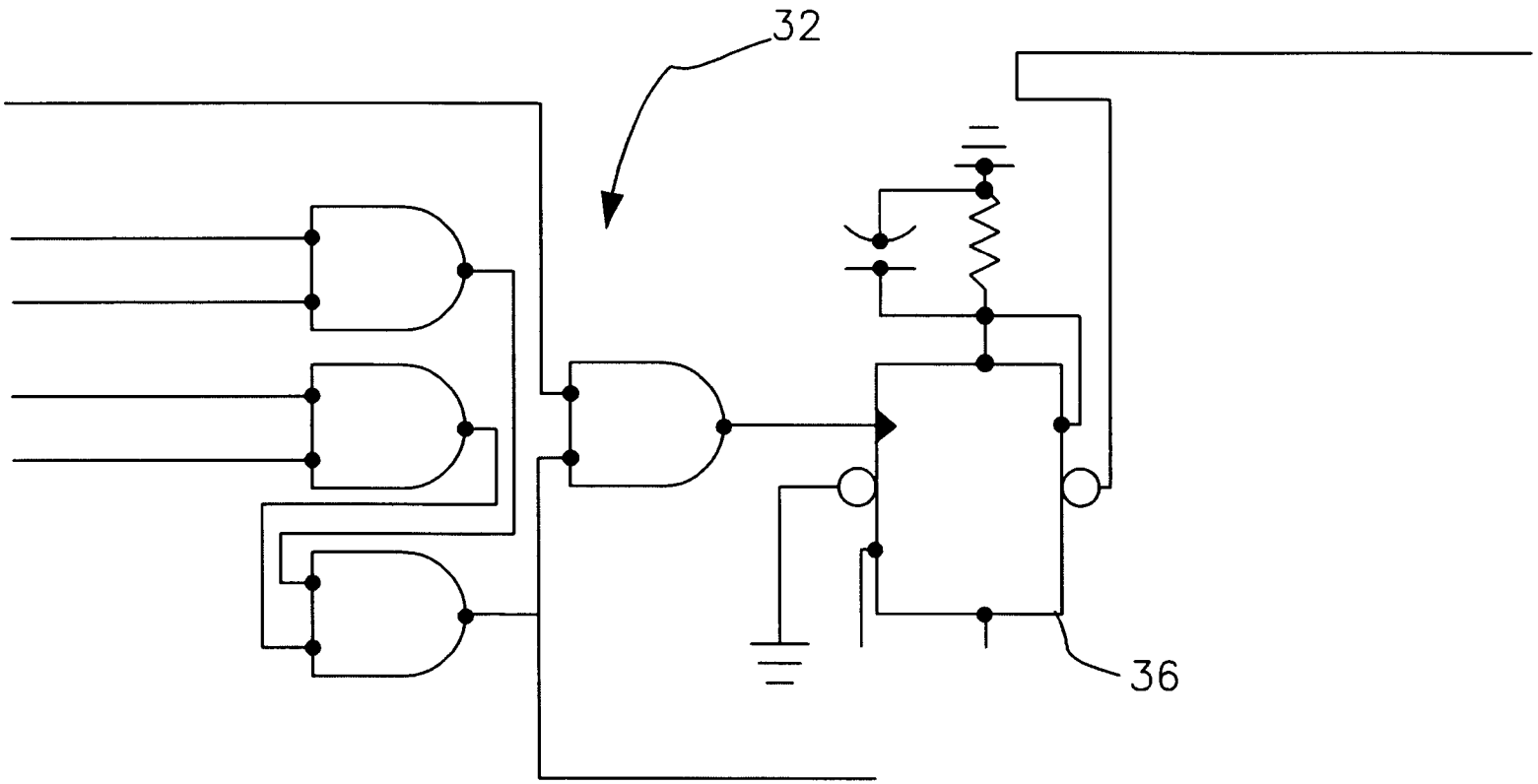
FIG. 2 is a schematic diagram of circuity associated with the second switch means.

The second switch means further includes a second orientation for governing the display means such that the timer increments. The present invention is utilized with the second switch means in this orientation when checking timing after top dead center. When the second switch means is in the second orientation thereof, the AND gates 34 of FIG. 2 serve to rest the 360 counter to 000.0 when the counters reach 360.0. It should be noted that the AND gates work in conjunction with a J–K flip flop 36, as shown in FIG. 2 to reset the 360 counters when an encoder direction is reversed with the 360 counters at 360.0. The purpose of the foregoing is to eliminate overflow (360.5).

A third switch means 38 is included having a corresponding J–K flip flop 40 that is used to latch the display means upon a low to high transmission, or activation signal, from the engine sensor. The third switch means has a first orientation for allowing the latching of the timer of the display means. While in the first orientation, the third switch means further precludes the restarting of the timer of the display means until the receipt of the manual signal. In other words, the third switch means latches the display means and holds it when the J–K flip flop receives the activation signal until the manual push button switch is depressed.

In a second orientation, the third switch means functions for allowing the latching of the timer of the display means and further allowing the restarting of the timer of the display means by the activation signal. As such, the third switch means latches the display means and holds it until another pulse transition from the J–K flip flop.

Yet another switch means may be included, namely a fourth switch means 42, for allowing the use of the present invention with engines wherein more than one cylinder fires at the same time, as in the case of motorcycles. In a first orientation, the fourth switch means updates the latched display means only as spark advance increases. It is imperative that the third switch means be in the second orientation thereof for this to function properly. The fourth switch means is further adapted to allow random latching of the display in a second orientation. Finally, while in a third orientation, the fourth switch means is adapted to allow the latching of the display between 039.0 and 000.0 degrees only.

Finally, a piego electric buzzer 44 along with a corresponding J–K flip flop 46 may be provided for generating an audible alarm upon the display means being latched. Shown in FIG. 1 are a pair of four-bit magnitude comparators 48 for checking spark advance. By holding a K-input high on the J–K flip flop of the third switch means, the display is kept latched until the counter value is greater than the display means value which forces the K-input low allowing the J–K flip flop to relatch, or update, the display means as the ignition advances. It should be noted that the specific integrated circuits depicted in the Figures are only single examples of circuits that could be employed to accomplish the desired objectives.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A digital degree wheel for testing ignition timing comprising:

a push button switch for generating a manual signal upon the depression thereof;

an engine sensor adapted to be mounted to at least one of the camshaft, distributor and crankshaft of a vehicle for generating an activation signal upon the rotation of at least one of the camshaft and crank shaft;

an ignition sensor adapted to be connected to an ignition of the vehicle for generating a deactivation signal upon the detection of the advancing of the ignition of the vehicle;

display means adapted to be connected to the ignition sensor and the engine sensor for displaying a plurality of numeric digits representative of a timer which is adapted to begin upon the receipt of the activation signal and further cease upon the receipt of the deactivation signal for setting and checking the ignition and valve timing of an engine of the vehicle;

first switch means having a first orientation for governing the display means such that the timer runs at a first rate and a second orientation for governing the display means such that the timer runs at a second rate;

second switch means having a first orientation for governing the display means such that the timer decrements and a second orientation for governing the display means such that the timer increments; and third switch means having a first orientation for allowing the latching of the timer of the display means and precluding the restarting of the timer of the display means until the receipt of the manual signal and further having a second orientation for allowing the latching of the timer of the display means and further allowing the restarting of the timer of the display means by the activation signal.

* * * * *